United States Patent [19]

Bowman

[11] Patent Number: 4,762,351

[45] Date of Patent: Aug. 9, 1988

[54] SECURITY DEVICE FOR DOORS

[76] Inventor: Edward W. Bowman, 1891 Irvine Blvd., Tustin, Calif. 92680

[21] Appl. No.: 742,289

[22] Filed: Jun. 7, 1985

[51] Int. Cl.[4] ..... E05C 17/32

[52] U.S. Cl. ..... 292/263

[58] Field of Search ..... 292/263, 264, 268, 269, 292/270

[56] References Cited

U.S. PATENT DOCUMENTS

| | | | |
|---|---|---|---|
| 609,214 | 8/1898 | Shaw | 292/263 |
| 924,081 | 6/1909 | Loev . | |
| 1,029,693 | 6/1912 | Klein | 292/263 |
| 2,093,039 | 9/1937 | Eamon | 292/271 X |
| 3,004,419 | 10/1961 | Folk, Jr. | 292/264 X |
| 4,391,463 | 7/1983 | Costa Bastart | 292/263 |

FOREIGN PATENT DOCUMENTS

| | | | |
|---|---|---|---|
| 2068451 | 8/1981 | United Kingdom | 292/268 |

*Primary Examiner*—Richard E. Moore

*Attorney, Agent, or Firm*—Knobbe, Martens, Olson & Bear

[57] ABSTRACT

A security device for limiting the opening of a door comprises a first base member mounted on a door and a second base member mounted on a door frame. A first connecting member is pivotably mounted on the second base member and a second connecting member is pivotably connected to said first connecting member. The second connecting member has a T-shaped end portion which is engageable with a T-shaped slot of the first base member. When the T-shaped end of the second connecting member is engaged in the slot of the first base member, the door is prevented from opening more than a distance which is insufficient to allow access to a room protected by the security device. Preferably, the security device includes biasing members so that the first and second connecting members are rotated away from the door opening when the T-shaped end portion of the second connecting member is disengaged from the slot of the first base member, to thereby reduce the probability of interference of the security device with the opening and closing of the door.

11 Claims, 1 Drawing Sheet

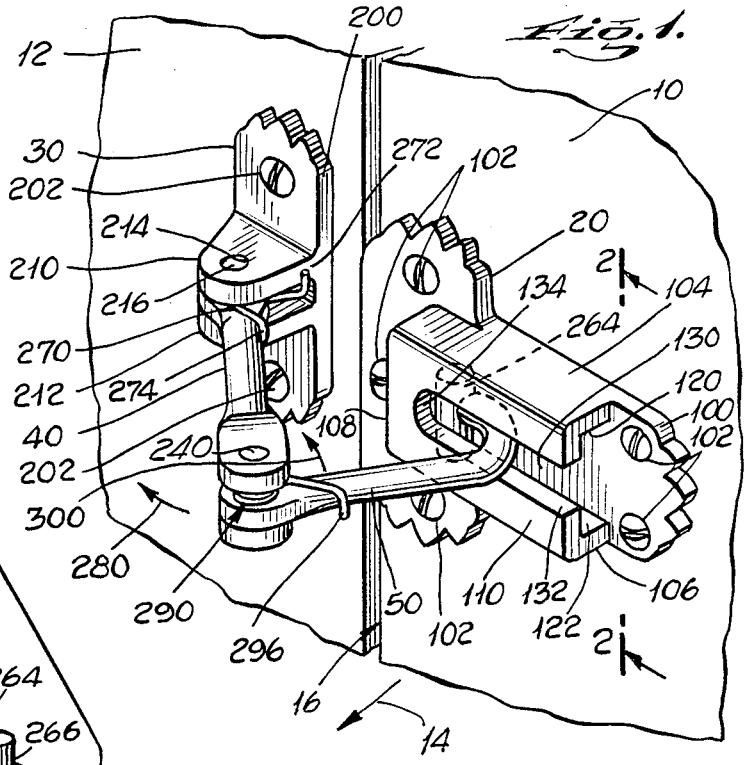
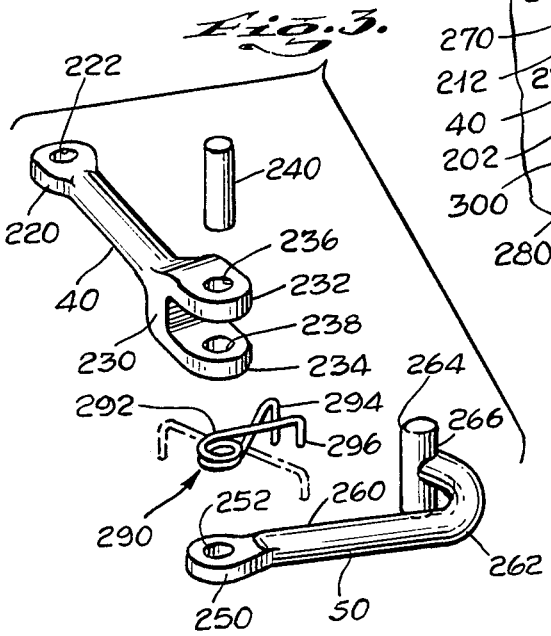
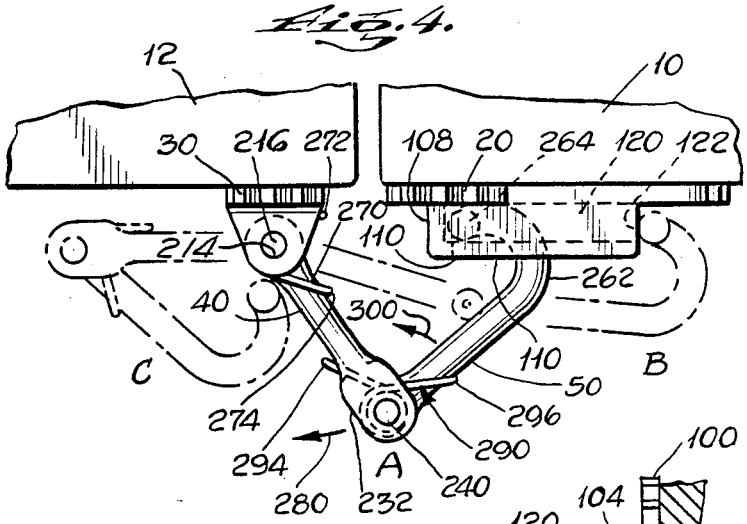
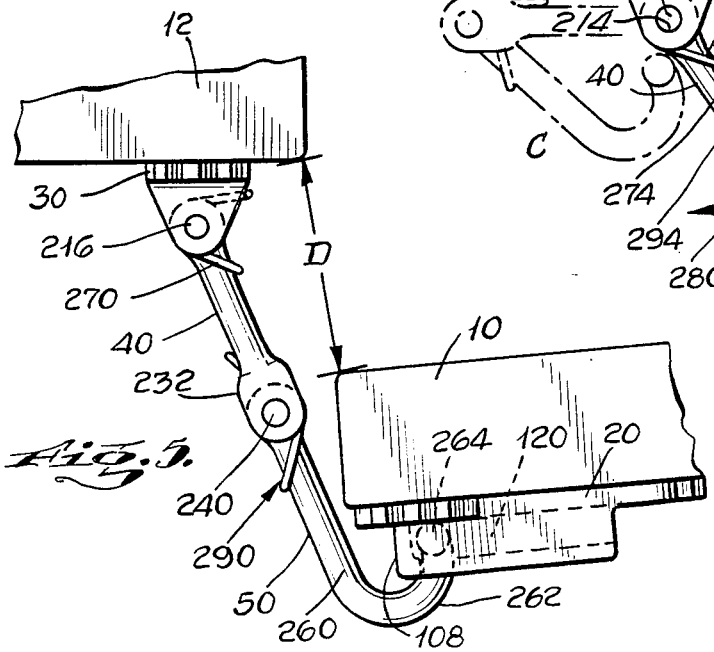
Fig. 5.
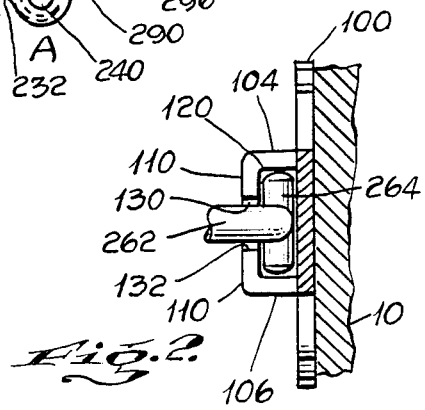
Fig. 2.

SECURITY DEVICE FOR DOORS

FIELD OF THE INVENTION

The present invention relates to security devices which allow a door to be partially opened for communication with a person on the outside of the door, while preventing access by that person.

BACKGROUND OF THE INVENTION

The security of persons in their homes, in offices, and in hotel rooms has long been a deep concern. In particular, it is desirable that persons on the outside of a room or building be kept on the outside until they are identified as persons to be admitted to the secured area. In order to accomplish this purpose, the familiar security chain is often used to allow a door to be partially opened so that persons seeking admittance can be identified through the opening thus formed without providing an opening of sufficient width to allow the person to enter. The security chain has a number of disadvantages including unsightliness, lack of strength because of its small size, and difficulty in use for persons having problems with manual dexterity. Furthermore, the typical door chain tends to mar the finish of the door and the frame around the door opening when in common use. Thus, a need exists for a security device which provides strength and ease of use with an aesthetic appearance, and which does not mar the finish on the door or the door frame.

SUMMARY OF THE INVENTION

Applicant has invented a security device for limiting the opening of a door. The device includes a first base member mounted proximate to the edge of a door. A second base member is mounted on a door frame in close proximity to the first base member when the door is closed in the passageway formed by the frame. The first base member has a slot which has a closed end nearer the second base member and an open end directed away from said second base member. A first connecting member has a first end which is pivotably connected to the second base member and also has a second end. The first connecting member pivots about a pivot axis which is parallel to the edge of the door. A second connecting member has a first end pivotably connected to the second end of the first connecting member and has a free second end for removable engagement with the slot in the first base member. When thus engaged, the door cannot be opened beyond the combined lengths of the first and second connecting members. The second connecting member pivots about a pivot axis which is parallel to and which pivots about the pivot axis of the first connecting member.

Preferably, the security device of the present invention further includes a first biasing member, such as a spring, which is mounted to engage the second base member and the first connecting member. The first biasing member provides a tension on the first connecting member such that when the free second end of the second connecting member is disengaged from the slot in the first base member, the tension of the first biasing member causes the first connecting member to be pivoted to a position away from the door opening so that the first and second connecting members do not obstruct the passageway or interfere with the opening and closing of the door.

The security device of the present invention also preferably includes a second biasing member, such as a second spring, which is mounted in engagement with the second end of the first connecting member and the first end of the second connecting member to provide a tension between the first and second connecting members so that the free second end of the second connecting member is biased for firm engagement with the closed end of the slot in the first base member when the free second end of the second connecting member is placed in the open end of the slot.

In the preferred embodiment of the security device of the present invention, the slot in the first base member has a T-shaped cross-section, having a wider portion corresponding to the crosspiece of a T and a narrower portion corresponding to the shaft of a T. The slot is positioned in the first base member such that when the first base member is mounted on a door, the crosspiece of said T-shape is near the surface of the door and the shaft of the T-shape is directed away from the surface of the door. Preferably, the free second end of the second connecting member is also T-shaped such that when the free second end of the second connecting member is placed in the slot of the first base member, the free second end of the second connecting member cannot be removed from the slot other than by longitudinal movement of the free second end out the open end of the slot.

The second connecting member of the security device of the present invention is preferably shaped so that a portion of the second connecting member proximate to the second end of the second connecting member is curved. The shape and radius of the curve is selected so that when the free second end of the second connecting member is engaged in the slot of the first base member and the door is partially opened, the first and second connecting members are spaced apart from the edge of the door by a distance sufficient to prevent contact of the first and second connecting members with the door. Thus, the security device of the present invention does not mar the finish of the door.

BRIEF DESCRIPTION OF THE DRAWINGS

FIG. 1 is perspective view of the device of the present invention mounted on a door frame and a door with the door in the closed position, and with the device engaged in the secured portion.

FIG. 2 is a partial cross-sectional view showing the engagement of the second base member and the second end of the second connecting member taken along lines 2—2 in FIG. 1.

FIG. 3 is an exploded perspective view of the moveable components of the present invention.

FIG. 4 is a plan view of the present invention illustrating in full lines, the fully locked position, and also illustrating two phantom line positions of the device, all with the door closed.

FIG. 5 is a plan view of the present invention in use to limit the distance by which a door can be opened.

DETAILED DESCRIPTION OF THE PREFERRED EMBODIMENT

The security device of the present invention is illustrated in FIG. 1 mounted on a door 10 and on a door frame 12. In the example hereinafter illustrated, the door 10 opens inwardly in the direction indicated by the arrow 14. When the door 10 is opened, the frame 12 forms a passageway for access to the area protected by the door. The device comprises a first base member 20, mounted on the door 10 proximate to an edge 16 of the door 10; a second base member 30, mounted on the door frame 12; a first connecting member 40, pivotably mounted to the second base member 30; and a second connecting member 50, pivotably mounted to the first connecting member 40. The first base member 20 and the second base member 30 are mounted such that when the door 10 is closed in the opening formed by the door frame 12, the first base member 20 and the second base member 30 are in a juxtaposed relationship.

The first base member 20 has a flat mounting plate 100 which is mounted on the surface of the door 10, and which is secured to the door 10 by screws 102 or other means of fastening, such as glue. The mounting plate 100 supports an upper plate 104, a lower plate 106 and an end plate 108. The upper plate 104 and the lower plate 106 are in parallel spaced relationship to each other, and are each perpendicular to the end plate 108. The upper plate 104, the lower plate 106 and the end plate 108 support a side plate 110 which is parallel to and spaced apart from the mounting plate 100. The mounting plate 100, the upper plate 104, the lower plate 106, the end plate 108, and the side plate 110 form a box-like cavity 120 which has an open end 122 which is parallel to and spaced apart from the end plate 108. As shown more clearly in FIG. 2, which is taken along the lines 2—2 in FIG. 1, the cavity 120 has a rectangular cross-section which has a height measured vertically and a width measured horizontally normal to the door. Preferably, the height of the cavity 120 is larger than the width.

Returning to FIG. 1, a portion of the material forming the side plate 110 is removed to form a horizontally disposed slot 130. The slot 130 extends through the side plate 110 in the direction normal to the surface of the door and thereby extends into the cavity 120. The slot 130 has a first open end 132 which adjoins the open end 122 of the cavity 120. The slot 130 has a closed end 134 which is proximate to the end plate 108. A substantial portion of the lateral side plate 110 remains after forming the slot 130 so that the vertical height of the slot 130 is less than the height of the opening 122 into the cavity 120. This is also illustrated more clearly in the cross-sectional view of FIG. 2. The cavity 120 and the slot 130 form a composite slot in the first base member which has a T-shaped cross-section. The vertical dimension of the cavity 120 corresponds to the crosspiece of the T and the slot 130 forms the shaft or stem of the T.

Returning again to FIG. 1, the second base member 30 also includes a flat plate portion 200 which is secured to the door frame 12 by screws 202 or other means of fastening. The second base member 30 supports a first ear 210 and a second ear 212 which are disposed perpendicular to the surface of the door frame 12. The first ear 210 has a vertically disposed hole 214, and the second ear 212 has a vertically disposed hole (not shown) which is aligned with the hole 214. A pin 216, having a diameter substantially equal to the diameter of the hole 214, is inserted into the two holes and secured therein by friction fit, brazing, a set screw, or other known fastening means.

As illustrated in FIG. 3, the first connecting member 40 has a first end 220 which has a vertically disposed hole 222. The hole 222 has a diameter which is slightly larger than the diameter of the pin 216. The first end 220 of the first connecting member 40 is placed between the ear 210 and the ear 212, and the pin 216 is secured in the holes in the ears 210 and 212. The first connecting member 40 swings freely around the pin 216. Thus, the pin 216 and the ears 210 and 212 act as a pivot for the first connecting member 40. The first connecting member 40 moves in a horizontal plane with respect to the second base member 30. The horizontal plane is perpendicular to the surface of the door opening formed by the frame 12. The first connecting member 40 pivots about a pivot axis formed by the pin 216. The pivot axis of the first connecting member 40 is parallel edge 16 of the door 10.

The first connecting member 40 has a fork-shaped second end 230 which has a first ear 232 and a second ear 234 which are parallel to and spaced apart from each other. The first ear 232 has a vertically disposed hole 236, and the second ear 234 has a vertically disposed hole 238 which is aligned with the hole 236. A pin 240 is provided which has an outside diameter which is substantially equal to the diameters of the holes 232 and 234 to provide a snug fit when the pin 240 is inserted into the holes 236 and 238. The pin 240 is secured in the holes 236 and 238 by friction fit, brazing, set screws, or other known fastening means.

The second connecting member 50 has a first end 250 which has a vertically disposed hole 252. The hole 252 has a diameter slightly larger than the outside diameter of the pin 240. The first end 250 of the second connecting member 50 is placed between the ear 232 and the ear 234 of the second end 230 of the first connecting member 40, and the pin 240 is secured in the holes 236 and 238. The ears 232 and 234, and the pin 240 provide a pivot for the second connecting member 50. The second connecting member moves in a horizontal plane with respect to the second base member 30 and the first connecting member 40. The second connecting member 50 pivots about a pivot axis formed by the pin 240. The pivot axis of the second interconnecting member 50 is parallel to and pivots about the pivot axis of the first connecting member 40.

The second connecting member 50 has a straight portion 260 connected to the first end 250 and a curved portion 262. The curved portion 262 interconnects the straight portion 260 with a vertically disposed portion 264. The vertically disposed portion 264 is mounted perpendicularly to the end of the curved portion 262 to form a T-shaped second end 266 on the second connecting member 50. The length of the vertically disposed portion 264 is selected so that it is less than the height of the cavity 120 in the first base member 20 but greater than the height of the slot 130. The thickness (i.e., the vertical dimension) of the curved portion 262 is selected to be less than the height of the slot 130. Thus, the vertically disposed portion 264 and the curved portion 262 will fit into the cavity 120 and the slot 130, respectively. This is shown in the cross-sectional view in FIG. 2. As illustrated, the T-shaped end formed by the curved portion 262 and the vertical portion 264 interlock with the T-shaped cross-section formed by the cavity 120 and the slot 130.

Returning again to FIG. 1, the preferred embodiment of the device includes a biasing member 270 which is preferably a torsion spring having a first leg portion 272 and a second leg portion 274. The first leg portion 272 is vertically disposed and is engaged with the ear 210. The second leg portion 274 is likewise vertically disposed and is engaged with the first connecting member 40. The first leg portion 272 and the second leg portion 274 of the biasing member 270 are connected to a biasing portion, such as a coil (not shown) so that the biasing member 270 produces a force which tends to pivot the first connecting member 40 away from the door 10 in the direction indicated by the arrow 280. In the preferred embodiment, the coil (not shown) surrounds the pin 216.

The device also preferably includes a second biasing member 290, which, in the preferred embodiment, is a torsion spring 290 as illustrated in FIG. 3. The torsion spring 290 includes a coil 292 and first and second leg portions 294 and 296, respectively. The first leg portion 294 is mounted to engage the first connecting member 40 and the second leg portion 296 is mounted to engage the second connecting member 50. The coil 292 is positioned around the pin 240. The second biasing member 290 is biased so that it applies pressure to pivot the second connecting member 50 with respect to the first connecting member 40 in the direction indicated by the arrow 300 in FIGS. 1 and 4.

The operation of the present invention is illustrated in FIGS. 4 and 5. FIG. 4 illustrates the device in three operational positions. Position A, shown in solid lines, is the position of the device in the secured position. The vertically disposed portion 264 of the second connecting member 50 has been inserted through the opening 122 into the cavity 120 of the first base member 20. When the vertical member 264 is inserted into the cavity 120, and the vertical member 264 is moved toward the door frame 12, the curved portion 262 enters the slot 130 via the open end 132 of the slot. The vertical member 264 moves horizontally until it reaches the inner surface of the end plate 108. Since the height of the slot 130 is less than the height of the cavity 120 and of the vertical member 264, the vertical member 264 cannot be removed from the cavity 120 by moving it in a direction perpendicular to the surface of the door 10. The only way that the vertical member 264 can be removed from the cavity 120 is by moving it horizontally in the direction away from the frame 12. This is illustrated in position B in phantom lines in FIG. 4.

The action of the second biasing member 290 is such that when the first connecting member 40 and the second connecting member 50 are in position A, the force of the second biasing member 290 on the second connecting member 50 is such that the vertical member 264 is firmly pressed against the inner surface of the end plate 108. Thus, there is no tendency for the vertical member 264 to move in the lateral direction away from the door frame 12 and thus become disengaged from the cavity 120. This is an advantageous feature which prevents vibrations or other slight movements of the door 10 or the connecting members 40 and 50 from causing the vertical member 264 to become accidentally disengaged from the cavity 120.

The lengths of the first interconnecting member 40 and the second connecting member 50 are selected such that when the door 10 is fully closed, and the first connecting member 40 and the second connecting member 50 are disposed in a substantially straight line, as illustrated at position B in FIG. 4, the vertical member 264 is positioned slightly beyond the opening 122 of the cavity 120 and can therefore be disengaged from the cavity 120. If the door 10 is partially opened, the combined lengths of the first connecting member 40 and the second connecting member 50 are insufficient to allow the vertical member 264 to be removed from the cavity 120. Thus, the vertical member 264 can only be disengaged from the cavity 120 when the door 10 is substantially closed with respect to the door frame 12.

When the vertical member 264 is disengaged from the cavity 120, the first biasing member 270 forces the first connecting member 40 to pivot in the direction indicated by the arrow 280 to the position shown in phantom lines at position C in FIG. 4. Furthermore, the second biasing member 290 causes the second connecting member 50 to pivot in the direction of the arrow 300 to the position shown in phantom lines at position C in FIG. 4. Thus, the security device of the present invention is folded neatly against the door frame 12 so that it does not interfere with the opening and the closing of the door 10. The second base member 30 preferably includes a stop (not shown) which prevents the first connecting member from rotating past the position shown in phantom lines at position C in FIG. 4. Thus, the first connecting member 40 does not contact the frame 12 when it is rotated to the position shown in phantom lines at position C. In the position shown at C, the first connecting member 40 and the second connecting member 50 are totally non-obstructive with respect to the opening and closing of the door and with respect to movement through te passageway formed by the door frame 12. Furthermore, since the device is spring-biased to automatically pivot to the position shown at C, no action is required by the user to cause the device to assume the non-obstructive position.

FIG. 5 illustrates the security device of the present invention as it is used to prevent the door 10 from being forced fully open when the door 10 is partially opened. This position of the door 10 permits a room occupant to communicate with a person outside the door without providing a passageway for the person to enter the room. With the vertical member 264 securely engaged against the inner surface of the end plate 108, the door 10 can be opened until the first connecting member 40 and the second connecting member 50 are disposed in a substantially straight line, as shown. At that point, any pressure against the door 10 will be transmitted through the vertical member 264 to the second connecting member 50, through the pin 240, to the first connecting member 40, and through the pin 216, to the second base member 30. So long as the second base member 30 is securely fastened to the frame 12, the door 10 cannot be opened any farther than the distance D shown in FIG. 5. The length of the first connecting member 40 and the second connecting member 50 are selected such that the distance D is sufficiently long to provide visible communication between a person on the inside of the door 10 and a person on the outside of the door 10, and sufficient to allow envelopes or small packages to be passed between the door 10 and the frame 12. However, the distance D is selected to be too short to allow a person to pass through the opening between the door 10 and the frame 12. Since the first connecting member 40 and the second connecting member 50 are constructed from solid material, such as steel, they have considerably more strength than a chain used in a typical, presently available security device.

FIG. 5 also illustrates another advantageous feature of the present invention. The curved portion 262 has a radius of curvature selected so that when the door 10 is opened to the full extent allowed by the combined lengths of the first connecting member 40 and the second connecting member 50, the second connecting member 50 is displaced from the edge of the door 10 by a distance sufficient to prevent the second connecting member 50 from contacting the edge of the door 10. The radius of curvature of the curved portion 262 is selected so that the distance from the vertically disposed end portion 264 to the straight portion 260 of the second connecting member 50 along any straight line is greater than the distance from the vertically disposed portion 264 to the edge of the door along the straight line when the end portion 264 is against the end plate 108 of the first base member 20. Thus, unlike security chains which tend to mar the finish of a door, the present invention only contacts the first base member 20 and the second base member 30. Thus, the present invention will not mar the finish of the door. Furthermore, since the first connecting member 40 and the second connecting member 50 fold back away from the door opening, as illustrated in FIG. 4, the present invention will not contact the door as it is opened and closed and will therefore not mar the inner and outer surfaces of the door. Since neither the first and second base members 20 and 30, nor the first and second connecting members 40 and 50 extend into the passageway formed by the door frame 12, there is no obstacle to the passage of persons through the passageway even when the persons are laden with wide packages or other objects.

The security device of the present invention can also be advantageously used with an outward opening door by mounting the first base member 20 on the door frame 12 and by mounting the second base member on the door frame 10.

The security device of the present invention can also be advantageously used with a sliding door 10. Instead of the first and second connecting members 40 and 50 assuming the positions shown in FIG. 5 when the door 10 is opened, the first and second connecting members will be in the extended position shown at B in FIG. 4. The sliding movement of the door 10 will be limited by the approximate length of the slot 130.

What is claimed is:

1. A security device for limiting the size of a passageway between an edge of a door and a door frame in which said door is mounted, comprising:

a first base member having a slot, said slot having an open end and a closed end;

means for mounting said first base member on one of said door and said door frame;

a second base member;

means for mounting said second member on the other of said door and said door frame in close proximity to said first base member when said door is closed to obstruct said passageway;

a first connecting member having a first end and a second end;

first pivot means for pivotably mounting said first end of said first connecting member to said second base member, said first pivot means having a first pivot axis so that said first connecting member pivots about said first pivot axis;

a second connecting member having a first end and a free second end;

second pivot means for pivotably mounting said first end of said second connecting member to said second end of said first connecting member, said second pivot means having a second pivot axis parallel to said first pivot axis so that said second connecting member pivots about said second pivot axis, said free second end of said second connecting member removably engageable with said slot in said first base member, said first and second connecting members interconnecting said first and second base members when said free second end is engaged in said slot to thereby limit the distance that said edge of said door can be moved away from said door frame; and a first biasing member mounted at said first pivot axis, having a first end engaging said second base member and a second end engaging said first connecting member, said first biasing member providing tension between said second base member and said first connecting member to cause said first connecting member to pivot about said first pivot axis to a position away from said edge of said door so that said free second end of said second connecting member does not extend into said passageway.

2. The security device as defined in claim 1 further comprising a second biasing member mounted at said second pivot axis, said second biasing member having a first end engaging said first connecting member and a second end engaging said second connecting member, said second biasing member providing tension between said first connecting member and said second connecting member to cause said second connecting member to pivot about said second pivot axis in a direction to move said free second end of said second connecting member into engagement with the closed end of said slot in said first base member.

3. The security device as defined in claim 2 wherein said second biasing member is a coil spring having a coiled portion around said second pivot axis and having first and second leg portions connecting said first and second ends of said second biasing member to said coil portion.

4. The security device as defined in claim 1 wherein said slot in said first base member comprises an inner cavity portion for receiving said free second end of said second connecting member and an outer slotted portion penetrating to said inner cavity portion, said inner cavity portion having a height in a direction parallel to said first and second pivot axes which is greater than the length of said free second end in said direction, said outer slotted portion having a height in said direction which is less than the length of said free second end in said direction.

5. The security device as defined in claim 1 wherein said second connecting member has a straight portion proximate to said first end of said second connecting member and a curved portion proximate to said free second end, said curved portion having a radius of curvature selected so that the distance from said free second end to said straight portion is greater than the distance from said closed end of said slot to the edge of said door when said first base member is mounted on said door.

6. The security device as defined in claim 1 wherein said first biasing member is a coil spring having a coiled portion around said first pivot axis and having first and second leg portions connecting said first and second ends of said first biasing member to said coil portion.

7. The security device as defined in claim 1, wherein said first pivot axis is parallel to the edge of the door.

8. A security device for limiting the size of a passageway between an edge of a door and a door frame in which said door is mounted, comprising:

a first base member having an engaging portion;

means for mounting said first base member on one of said door and said door frame;

a second base member;

means for mounting said second base member on the other of said door and door frame in proximity to said first base member when said door is closed in said door frame to obstruct said passageway;

a connecting member having a first end and a free second end;

means for pivotably mounting said first end of said connecting member to said second base member so that said connecting member pivots about a pivot axis, said free second end of said connecting member removably engageable with said engaging portion of said first base member to interconnect said first base member with said second base member and thereby limit the distance by which said edge of said door can be separated from said door frame; and a biasing member mounted at said pivot axis, having a first end engaging said second base member and a second end engaging said connecting member, said biasing member providing tension between said second base member and said connecting member to cause said connecting member to pivot about said pivot axis to a position away from said edge of said door when said free second end is disengaged from said engaging portion of said first base member so that said connecting member does not extend into said passageway.

9. The security device as defined in claim 8 wherein said connecting member comprises first and second pivotably interconnected portions, said first interconnected portion having first and second ends and said second interconnected portion having first and second ends, wherein said first end of said first interconnected portion is said first end of said connecting member pivotably connected to said second base portion, wherein said second end of said first interconnection portion is pivotably connected to said first end of said second interconnected portion, and wherein said second end of said second interconnected portion is said free second end of said connecting member that is removably engageable with said engaging portion of said first base member.

10. The security device as defined in claim 8, wherein said pivot axis is parallel to the edge of the door.

11. A security system for limiting access to a room, comprising:

a door frame mounted in an opening in a wall of said room;

a door pivotally mounted at one side of said door frame for selectively closing said opening;

a first base member mounted to one of said door and said door frame;

a second base member mounted to the other of said door and said door frame;

a connecting member connected to said first base member and removably connectable to said second base member to permit partial opening of said door but to limit the amount by which said door can be opened; and a biasing member connected to said connecting member to move said connecting member away from said junction of said door and said door frame only when said connecting member is disconnected from said second base member so that said connecting member does not extend across said junction between said door and said door frame.

* * * * *